US012599158B2

(12) United States Patent
Qian et al.

(10) Patent No.: US 12,599,158 B2
(45) Date of Patent: Apr. 14, 2026

(54) SUCKING PARTICLE FOR HEAT-NOT-BURN CIGARETTES AND MANUFACTURING METHOD

(71) Applicant: GUANGDONG WONDERFUL INTERNATIONAL BIOTECHNOLOGY CO., LTD., Guangdong (CN)

(72) Inventors: Jianbing Qian, Jinan (CN); Lei Ma, Jinan (CN); Baoming Zhan, Jinan (CN)

(73) Assignee: GUANGDONG WONDERFUL INTERNATIONAL BIOTECHNOLOGY CO., LTD., Guangdong (CN)

( * ) Notice: Subject to any disclaimer, the term of this patent is extended or adjusted under 35 U.S.C. 154(b) by 692 days.

(21) Appl. No.: 16/760,151

(22) PCT Filed: Sep. 3, 2018

(86) PCT No.: PCT/CN2018/103849
§ 371 (c)(1),
(2) Date: Apr. 29, 2020

(87) PCT Pub. No.: WO2019/119874
PCT Pub. Date: Jun. 27, 2019

(65) Prior Publication Data

US 2020/0337363 A1 Oct. 29, 2020

(30) Foreign Application Priority Data

Dec. 18, 2017 (CN) ..... 201711361766.2

(51) Int. Cl.
*A24B 3/14* (2006.01)
*A24B 3/12* (2006.01)
*A24B 15/30* (2006.01)

(52) U.S. Cl.
CPC ..... *A24B 3/14* (2013.01); *A24B 3/12* (2013.01); *A24B 15/302* (2013.01)

(58) Field of Classification Search
CPC ..... A24B 15/302; A24B 3/12; A24B 3/14; A24D 3/061
See application file for complete search history.

(56) References Cited

U.S. PATENT DOCUMENTS 5,148,820 A * 9/1992 Klammer ..... A24B 13/00 131/311
2007/0000505 A1* 1/2007 Zhuang ..... A24B 15/14 131/342

(Continued)

FOREIGN PATENT DOCUMENTS

WO WO-2017025924 A1 * 2/2017 ..... A24B 15/303

OTHER PUBLICATIONS

CN 101128130 B (Machine Translation) [online], [retrieved on Oct. 14, 2022], retrieved from Google Patents (https://patents.google.com/).*

*Primary Examiner* — Philip Y Louie
*Assistant Examiner* — Yana B Krinker
(74) *Attorney, Agent, or Firm* — Juan Carlos A. Marquez; Marquez IP Law Office, PLLC

(57) ABSTRACT

The invention discloses a sucking particle for heat-not-bum cigarettes, which comprises the following components by weight fraction: 8-20 parts of microcrystalline cellulose, 50-80 parts of tobacco powder, 0.5-2 parts of tobacco pyrolysate, 1 part of physiological taste adjusting component of tobacco, 8-30 parts of atomizing agent, 0.1-2 parts of tobacco essence and 1-10 parts of propylene glycol; the present invention further provides a manufacturing method for the above product. The product has the benefits of good heating performance, rapid atomizing when heated at 250-310° C. with a heating sheet, complete heating and consid- (Continued)

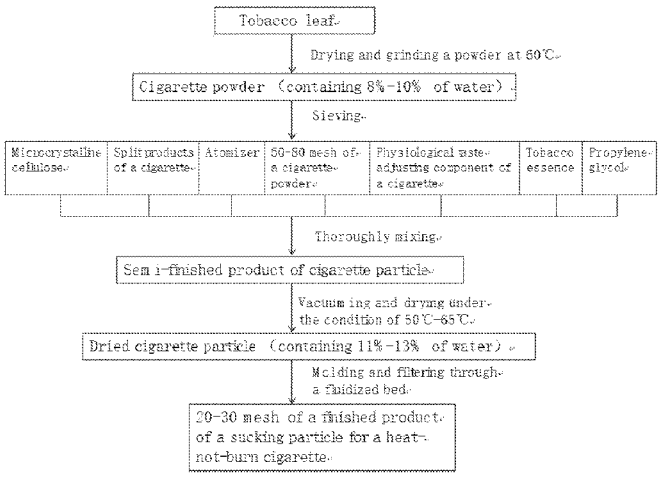

erable smoke, similar tobacco aroma and physiological satisfaction as smoking traditional cigarettes and less processing difficulty.

6 Claims, 1 Drawing Sheet

(56) References Cited

U.S. PATENT DOCUMENTS

| | | | | |
|---|---|---|---|---|
| 2010/0300465 | A1* | 12/2010 | Zimmermann | A24B 15/14 131/274 |
| 2011/0232657 | A1* | 9/2011 | Karles | A24B 15/186 131/300 |
| 2013/0071338 | A1* | 3/2013 | Andersen | A61K 31/465 514/343 |

* cited by examiner

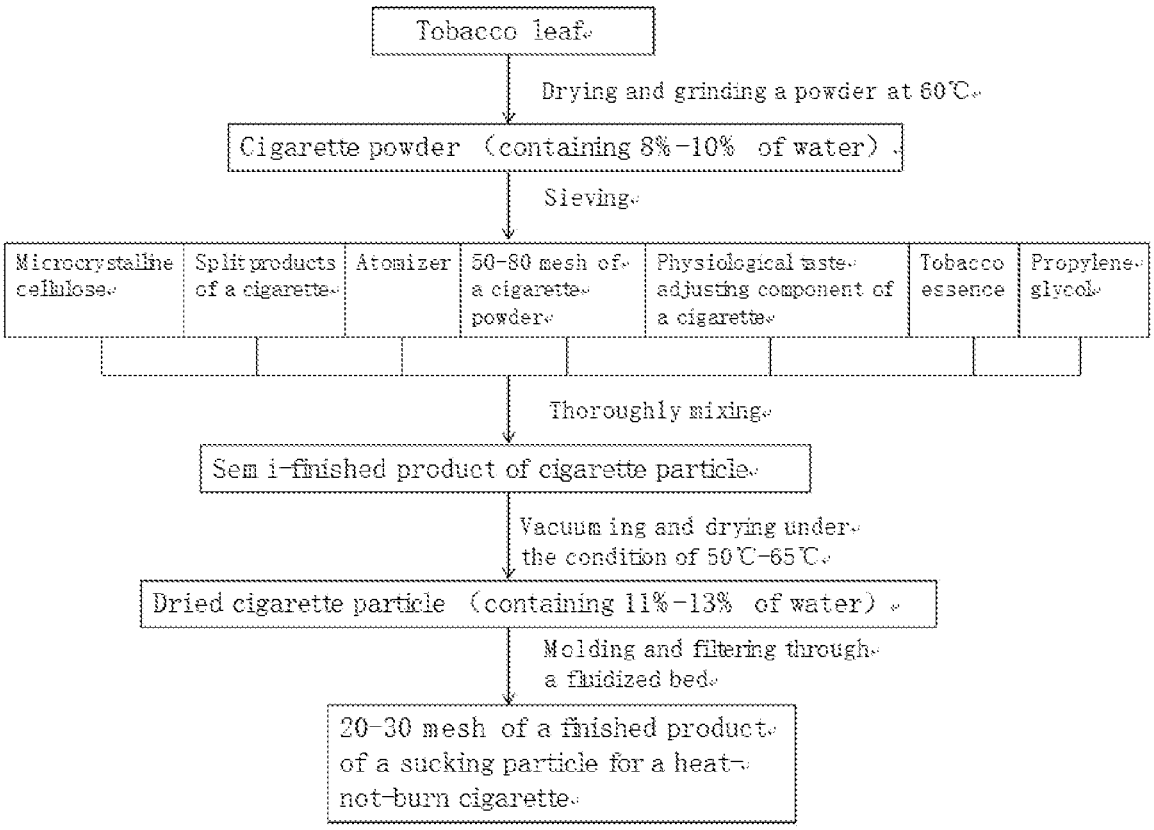
Tobacco leaf
Drying and grinding a powder at 60℃
Cigarette powder (containing 8%-10% of water)
Sieving
Microcrystalline cellulose
Split products of a cigarette
Atomizer
50-80 mesh of a cigarette powder
Physiological taste adjusting component of a cigarette
Tobacco essence
Propylene glycol
Thoroughly mixing
Sem i-finished product of cigarette particle
Vacuum ing and drying under the condition of 50℃-65℃
Dried cigarette particle (containing 11%-13% of water)
Molding and filtering through a fluidized bed
20-30 mesh of a finished product of a sucking particle for a heat-not-burn cigarette

SUCKING PARTICLE FOR HEAT-NOT-BURN CIGARETTES AND MANUFACTURING METHOD

TECHNICAL FIELD

The present invention belongs to the technical field of new tobacco products, and particularly relates to a sucking particle for heat-not-burn cigarettes and manufacturing method.

BACKGROUND

At present, the main tobacco fillers of heat-not-burn products in the market are cut tobacco, slurry process-based tobacco sheet and paper-making process-based tobacco sheet, which are heated and atomized by a special electric heating apparatus to deliver the feeling of smoking to smokers. The electric heating temperature is 250-310° C. generally, far lower than the cigarette burning temperature of 700-800° C.

There are some common problems of the heat-not-burn materials. For example, due to the relatively high density of the tobacco fillers some of which have a relatively high content of wood pulp fibers and other components, the tobacco fillers are slowly heated and have poor heat conduction, or due to the shape of tobacco, heating is not uneven and therefore the feeling of smokers smoking traditional low tar cigarettes cannot be achieved, or due to no tobacco specific physiological taste adjusting components are added, there is a great difference between the resulting physiological satisfaction and that from smoking traditional cigarette products.

At the same time, there are some problems in the processing technology of tobacco fillers of heat-not-burn cigarettes. For example, the Chinese patent CN104366687B discloses that raw tobacco materials are preliminarily pulverized into powder with a pulverizer, the length of the powder is less than 2 cm and the diameter is less than 0.2 cm, and the powder obtained is put into a microwave expansion equipment for microwave expansion at a single tube power of 1.5 KW and a high frequency of 2,450 MHz for 20-40 minutes to obtain the expanded semi-finished particles. This process is common at present. However, by microwave expansion or steps in which the processing temperature is high, the tobacco aroma substances are prone to lose, making it unable to experience the aroma of traditional low tar cigarettes.

SUMMARY

In view of the disadvantages of the prior art, the present invention aims to provide a sucking particle for heat-not-bum cigarettes and a manufacturing method to overcome the defects of a sucking product for heat-not-burn cigarettes of the prior art.

To achieve the above objectives, the technical solution of the present invention is as follows:

A sucking particle for heat-not-burn cigarettes, comprising the following components by weight fraction: 8-20 parts of microcrystalline cellulose, 50-80 parts of tobacco powder, 0.5-2 parts of tobacco pyrolysate, 1 part of physiological taste adjusting component of tobacco, 8-30 parts of atomizing agent, 0.1-2 parts of tobacco essence and 1-10 parts of propylene glycol.

Preferably, the tobacco pyrolysate is a product of tobacco pyrolysis at 250-310° C. by far-infrared heating.

Preferably, the pyrolysis tobacco is one or more of flue-cured tobacco, air-cured tobacco or sun-cured tobacco.

Preferably, the pyrolysis tobacco is Zimbabwean flue-cured tobacco.

Preferably, the physiological taste adjusting component of the tobacco is composed of alkaloid and water.

Preferably, the alkaloid is selected from nicotine or caffeine:

if nicotine is selected, the physiological taste adjusting component of the tobacco is composed of 20-40% nicotine and 60-80% water;

if caffeine is selected, the physiological taste adjusting component of the tobacco is composed of 5-20% caffeine and 80-95% water.

Preferably, the physiological taste adjusting component of the tobacco is composed of 35% nicotine and 65% water.

Preferably, the atomizing agent is polyol or an ester derivative of polyol.

Preferably, the atomizing agent is vegetable glycerin or glycerin.

Preferably, the atomizing agent is vegetable glycerin. The preferable atomizing agent is vegetable glycerin. Vegetable glycerin is extracted from natural plants, which is safe to use and has the advantages of considerable smoke, smooth fume, sweet taste and making the throat more comfortable when smoking.

A manufacturing method of the sucking particle for heat-not-burn cigarettes comprises the following steps:

A. drying and grinding tobacco leaves into powder at 60° C., controlling the moisture content at 8-10%, sieving and taking 50-80 mesh tobacco powder as raw materials;

B. mixing the 50-80 mesh tobacco powder obtained in step A with the microcrystalline cellulose, the tobacco pyrolysate, the physiological taste adjusting component of tobacco, the atomizing agent, the tobacco essence and the propylene glycol well to prepare the semi-finished tobacco particles;

C. drying the semi-finished tobacco particles obtained in step B at 50-65° C. and a vacuum degree of 20-40 Pa, the moisture content of the dried tobacco particles being 11-13%;

D. shaping the dried tobacco particles obtained in step C through a fluidized bed (the fluidized bed is the ZLG-4.5×0.6 bed of Changzhou Lemar, the moisture content and output of the discharging materials can be controlled by amplitude and feeding amount, and the discharging temperature is less than 40° C.), and sieving to obtain the final 20-30 mesh sucking particles for heat-not-burn cigarettes.

The present invention has positive and progressive beneficial effects: 1. good heating performance; 2. rapid atomizing when heated at 250-310° C. with a heating sheet; 3. complete heating and considerable smoke; 4. similar tobacco aroma and physiological satisfaction as smoking traditional cigarettes; 5. less processing difficulty.

BRIEF DESCRIPTION OF DRAWINGS

FIG. 1 is the manufacturing process flow chart of a sucking particle for heat-not-burn cigarettes.

DETAILED DESCRIPTION

The tobacco powder of the present invention is one kinds of flue-cured tobacco, air-cured tobacco or sun-cured tobacco, which is ground into powder with a pulverizer and dried at 60° C., has a moisture content controlled at 8-10% and then sieved to obtain 50-80 mesh tobacco powder. The tobacco powder of the present invention is preferably the strong-flavored flue-cured tobacco powder or the burley tobacco powder or the aromatic tobacco powder.

The tobacco pyrolysate of the present invention is the product of one or more of flue-cured tobacco, air-cured tobacco or sun-cured tobacco by high-temperature pyrolysis at 250-310° C. (which is determined according to the heating temperature when smoking particles for heat-not-burn cigarettes, for example, if such heating temperature is 280° C., then the far-infrared heating temperature is 280° C.) by far-infrared heating, and the main components of the product include nicotine, aromatic oil components of tobacco, aldehyde, ketone, sugar, acid, ester and other substances. Most of these substances have the unique aroma of tobacco and improve the cigarette smoking quality. The preferable pyrolysis tobacco is Zimbabwean flue-cured tobacco. In addition, compared with the traditional steam, hot air and resistance heating methods, the far-infrared heating selected for the present invention has many advantages, such as quick heating, good quality of new products, small equipment footprint, low production cost and high heating efficiency, and the tobacco pyrolysate prepared thereby has better quality and is free of any foreign or odd flavor. The role of the tobacco pyrolysate at the above specific temperature in the present invention is to increase tobacco aroma substances and significantly enhance the satisfaction with natural tobacco aroma and smoke, which is first advantage of the present invention.

The physiological taste adjusting component of the tobacco of the present invention is composed of alkaloid and water; the alkaloid is selected from nicotine or caffeine; the physiological taste adjusting component of the tobacco is prepared by mass percentage: 20-40% nicotine and 60-80% water, or 5-20% caffeine and 80-95% water; the physiological taste adjusting component of the tobacco is further preferably prepared by mass percentage: 35% nicotine and 65% water. The physiological taste adjusting component of the tobacco of the present invention plays a role of enhancing physiological satisfaction and refreshing and brings the same physiological impact as that from traditional cigarettes, which is the second advantage of the present invention.

The above tobacco pyrolysate and physiological taste adjusting component of tobacco are important components of a sucking particle for heat-not-burn cigarettes of the present invention. The effect of the combination of these components is very desirable, which makes smokers feel a strong physiological satisfaction and tobacco taste satisfaction.

The atomizing agent of the present invention can be selected from polyol or an ester derivative of polyol, or vegetable glycerin or glycerin; the atomizing agent is further preferably vegetable glycerin; the atomizing agent of the present invention is preferably vegetable glycerin, the reasons for which are that the amount of smoke can be effectively increased, the taste is naturally sweet when smoking and that the fume is soft. The addition of vegetable glycerin greatly improves the smoking effect of the sucking particle for heat-not-burn cigarettes of the present invention, which is the third advantage of the present invention.

The microcrystalline cellulose of the present invention is purified and partially depolymerized cellulose, white, odorless and tasteless and is crystalline powder posed of porous particles. It, as an important pelletizing and forming carrier for the production of tobacco particles, has a good pelletizing effect and pelletizes uniformly, and the size of the formed particles is controllable. Moreover, the formed particles have a good loose structure, which facilitates later more complete and full heating. It originates from all natural plants, is non-toxic and harmless and will produce no unpleasant odor that is discordant with tobacco scent when heated. The use of microcrystalline cellulose as the carrier is the fourth advantage of the present invention.

The tobacco essence of the present invention is not restricted on its type and source and is commercially available. The tobacco essence known by those skilled in the art can be used.

In order to make it easy to understand the technical means, creative features, purposes and effects of the present invention, the present invention will be further described with reference to specific embodiments.

Embodiment 1

A sucking particle for heat-not-burn cigarettes, comprising the following components by weight fraction: 15.5 parts of microcrystalline cellulose, 50 parts of strong-flavored flue-cured tobacco powder, 0.5 parts of pyrolysate of Zimbabwean flue-cured tobacco at 280° C., 1 part of physiological taste adjusting component of tobacco, 30 parts of vegetable glycerin, 2 parts of tobacco essence and 1 part of propylene glycol. The manufacturing steps are as follows:

1. drying and grinding the strong-flavored flue-cured tobacco leaves into powder, controlling the moisture content at 8% at 60° C., sieving and taking 50-80 mesh tobacco powder as raw materials;
2. mixing the 50-80 mesh tobacco powder obtained in step 1 with the microcrystalline cellulose, the pyrolysate of Zimbabwean flue-cured tobacco at 280° C., the physiological taste adjusting component of tobacco, the vegetable glycerin, the tobacco essence and the propylene glycol well to prepare the semi-finished tobacco particles;
3. drying the semi-finished tobacco particles obtained in step 2 at 50-65° C. and a vacuum degree of 20 Pa, the moisture content of the dried tobacco particles being 11%;
4. shaping the dried tobacco particles obtained in step 3 through a fluidized bed (the fluidized bed is the ZLG-4.5×0.6 bed of Changzhou Lemar, the moisture content and output of the discharging materials can be controlled by amplitude and feeding amount, and the discharging temperature is less than 40° C.), and sieving to obtain 20-30 mesh tobacco particles, i.e., the final sucking particles for heat-not-burn cigarettes.

The formula of the physiological taste adjusting component of tobacco of the present embodiment is 20% nicotine and 80% water by mass percentage.

The application of the sucking particles of the present embodiment in an electrically heated cigarette indicates that at a heating temperature of 280° C. for 1-2 seconds, the formation of smoke, smoking effect, considerable smoke, thick and natural tobacco aroma and strong physiological satisfaction can be achieved.

Embodiment 2

A sucking particle for heat-not-burn cigarettes, comprising the following components by weight fraction: 20 parts of microcrystalline cellulose, 50 parts of strong-flavored flue-cured tobacco powder, 2 parts of pyrolysate of Zimbabwean flue-cured tobacco at 250° C., 1 part of physiological taste adjusting component of tobacco, 15 parts of vegetable glycerin, 2 parts of tobacco essence and 10 parts of propylene glycol. The manufacturing steps are as follows:

1. drying and grinding the strong-flavored flue-cured tobacco leaves into powder, controlling the moisture content at 10% at 60° C., sieving and taking 50-80 mesh tobacco powder as raw materials;
2. mixing the 50-80 mesh tobacco powder obtained in step 1 with the microcrystalline cellulose, the pyrolysate of Zimbabwean flue-cured tobacco at 250° C., the physiological taste adjusting component of tobacco, the vegetable glycerin, the tobacco essence and the propylene glycol well to prepare the semi-finished tobacco particles;
3. drying the semi-finished tobacco particles obtained in step 2 at 50-65° C. and a vacuum degree of 40 Pa, the moisture content of the dried tobacco particles being 13%;
4. shaping the dried tobacco particles obtained in step 3 through a fluidized bed (the fluidized bed is the ZLG-4.5×0.6 bed of Changzhou Lemar, the moisture content and output of the discharging materials can be controlled by amplitude and feeding amount, and the discharging temperature is less than 40° C.), and sieving to obtain 20-30 mesh tobacco particles, i.e., the final sucking particles for heat-not-burn cigarettes.

The formula of the physiological taste adjusting component of tobacco of the present embodiment is 5% caffeine and 95% water by mass percentage.

The application of the sucking particles of the present embodiment in an electrically heated cigarette indicates that at a heating temperature of 250° C. for 2-3 seconds, the formation of smoke, smoking effect, considerable smoke, thick and natural tobacco aroma and strong physiological satisfaction can be achieved.

Embodiment 3

A sucking particle for heat-not-burn cigarettes, comprising the following components by weight fraction: 12 parts of microcrystalline cellulose, 62.4 parts of strong-flavored flue-cured tobacco powder, 2 parts of pyrolysate of Zimbabwean flue-cured tobacco at 280° C., 1 part of physiological taste adjusting component of tobacco, 15 parts of vegetable glycerin, 0.1 parts of tobacco essence and 7.5 parts of propylene glycol. The manufacturing steps are as follows:

1. drying and grinding the strong-flavored flue-cured tobacco leaves into powder, controlling the moisture content at 9% at 60° C., sieving and taking 50-80 mesh tobacco powder as raw materials;
2. mixing the 50-80 mesh tobacco powder obtained in step 1 with the microcrystalline cellulose, the pyrolysate of Zimbabwean flue-cured tobacco at 280° C., the physiological taste adjusting component of tobacco, the vegetable glycerin, the tobacco essence and the propylene glycol well to prepare the semi-finished tobacco particles;
3. drying the semi-finished tobacco particles obtained in step 2 at 50-65° C. and a vacuum degree of 20-40 Pa, the moisture content of the dried tobacco particles being 12%;
4. shaping the dried tobacco particles obtained in step 3 through a fluidized bed (the fluidized bed is the ZLG-4.5×0.6 bed of Changzhou Lemar, the moisture content and output of the discharging materials can be controlled by amplitude and feeding amount, and the discharging temperature is less than 40° C.), and sieving to obtain 20-30 mesh tobacco particles, i.e., the final sucking particles for heat-not-burn cigarettes.

The application of the sucking particles of the present embodiment in an electrically heated cigarette indicates that at a heating temperature of 280° C. for 1-2 seconds, the formation of smoke, smoking effect, considerable smoke, thick and natural tobacco aroma and strong physiological satisfaction can be achieved.

The present embodiment is preferred. The heat-not-burn particles prepared according to the present embodiment 3 have excellent smoking effect, give the aroma and taste as smoking traditional cigarettes, have the advantages of soft fume, sweet taste and promoting the secretion of saliva, and have a long quality-guarantee period even for 3 years while keeping good quality.

The formula of the physiological taste adjusting component of tobacco of the present embodiment is 35% nicotine and 65% water by mass percentage. Nicotine, which is one of the characteristic substances contained in tobacco itself and an important component of tobacco, has the effect of refreshing and improving physiological satisfaction. However, neither the greater nor the smaller amount of the nicotine added the better, but the moderate amount is the best.

The atomizing agent added in the present embodiment is vegetable glycerin, which combines with the physiological taste adjusting component of tobacco of the present embodiment at the proportion according to the present embodiment to achieve a preferred effect, so that the final sucking particles for heat-not-burn cigarettes in the present embodiment give the natural sweetness when smoking, highlighting the natural tobacco aroma and comfortable smoking feeling and satisfying well physiologically.

Embodiment 4

A sucking particle for heat-not-burn cigarettes, comprising the following components by weight fraction: 8 parts of microcrystalline cellulose, 80 parts of strong-flavored flue-cured tobacco powder, 0.9 parts of pyrolysate of Zimbabwean flue-cured tobacco at 280° C., 1 part of physiological taste adjusting component of tobacco, 8 parts of vegetable glycerin, 0.1 parts of tobacco essence and 2 parts of propylene glycol.

1. drying and grinding the strong-flavored flue-cured tobacco leaves into powder, controlling the moisture content at 9.5% at 60° C., sieving and taking 50-80 mesh tobacco powder as raw materials;
2. mixing the 50-80 mesh tobacco powder obtained in step 1 with the microcrystalline cellulose, the pyrolysate of Zimbabwean flue-cured tobacco at 280° C., the physiological taste adjusting component of tobacco, the vegetable glycerin, the tobacco essence and the propylene glycol well to prepare the semi-finished tobacco particles;
3. drying the semi-finished tobacco particles obtained in step 2 at 50-65° C. and a vacuum degree of 20-40 Pa, the moisture content of the dried tobacco particles being 11.5%;
4. shaping the dried tobacco particles obtained in step 3 through a fluidized bed (the fluidized bed is the ZLG-4.5×0.6 bed of Changzhou Lemar, the moisture content and output of the discharging materials can be controlled by amplitude and feeding amount, and the discharging temperature is less than 40° C.), and sieving to obtain 20-30 mesh tobacco particles, i.e., the final sucking particles for heat-not-burn cigarettes.

The formula of the physiological taste adjusting component of tobacco of the present embodiment is 40% nicotine and 60% water by mass percentage.

The application of the sucking particles of the present embodiment in an electrically heated cigarette indicates that at a heating temperature of 280° C. for 1-2 seconds, the formation of smoke, smoking effect, considerable smoke, thick and natural tobacco aroma and strong physiological satisfaction can be achieved.

Embodiment 5

A sucking particle for heat-not-burn cigarettes, comprising the following components by weight fraction: 20 parts of microcrystalline cellulose, 56 parts of strong-flavored flue-cured tobacco powder, 2 parts of pyrolysate of Zimbabwean flue-cured tobacco at 280° C., 1 part of physiological taste adjusting component of tobacco, 15 parts of vegetable glycerin, 1 part of tobacco essence and 5 parts of propylene glycol.

1. drying and grinding the strong-flavored flue-cured tobacco leaves into powder, controlling the moisture content at 10% at 60° C., sieving and taking 50-80 mesh tobacco powder as raw materials;
2. mixing the 50-80 mesh tobacco powder obtained in step 1 with the microcrystalline cellulose, the pyrolysate of Zimbabwean flue-cured tobacco at 280° C., the physiological taste adjusting component of tobacco, the vegetable glycerin, the tobacco essence and the propylene glycol well to prepare the semi-finished tobacco particles;
3. drying the semi-finished tobacco particles obtained in step 2 at 50-65° C. and a vacuum degree of 20-40 Pa, the moisture content of the dried tobacco particles being 12%;
4. shaping the dried tobacco particles obtained in step 3 through a fluidized bed (the fluidized bed is the ZLG-4.5×0.6 bed of Changzhou Lemar, the moisture content and output of the discharging materials can be controlled by amplitude and feeding amount, and the discharging temperature is less than 40° C.), and sieving to obtain 20-30 mesh tobacco particles, i.e., the final sucking particles for heat-not-burn cigarettes.

The formula of the physiological taste adjusting component of tobacco of the present embodiment is 20% caffeine and 80% water by mass percentage.

The application of the sucking particles of the present embodiment in an electrically heated cigarette indicates that at a heating temperature of 280° C. for 1-2 seconds, the formation of smoke, smoking effect, considerable smoke, thick and natural tobacco aroma and strong physiological satisfaction can be achieved.

Embodiment 6

A sucking particle for heat-not-burn cigarettes, comprising the following components by weight fraction: 8 parts of microcrystalline cellulose, 74.9 parts of strong-flavored flue-cured tobacco powder, 1 part of pyrolysate of Zimbabwean flue-cured tobacco at 310° C., 1 part of physiological taste adjusting component of tobacco, 10 parts of vegetable glycerin, 0.1 parts of tobacco essence and 5 parts of propylene glycol.

1. drying and grinding the strong-flavored flue-cured tobacco leaves into powder, controlling the moisture content at 9% at 60° C., sieving and taking 50-80 mesh tobacco powder as raw materials;
2. mixing the 50-80 mesh tobacco powder obtained in step 1 with the microcrystalline cellulose, the pyrolysate of Zimbabwean flue-cured tobacco at 310° C., the physiological taste adjusting component of tobacco, the vegetable glycerin, the tobacco essence and the propylene glycol well to prepare the semi-finished tobacco particles;
3. drying the semi-finished tobacco particles obtained in step 2 at 50-65° C. and a vacuum degree of 20-40 Pa, the moisture content of the dried tobacco particles being 12.5%;
4. shaping the dried tobacco particles obtained in step 3 through a fluidized bed (the fluidized bed is the ZLG-4.5×0.6 bed of Changzhou Lemar, the moisture content and output of the discharging materials can be controlled by amplitude and feeding amount, and the discharging temperature is less than 40° C.), and sieving to obtain 20-30 mesh tobacco particles, i.e., the final sucking particles for heat-not-burn cigarettes.

The formula of the physiological taste adjusting component of tobacco of the present embodiment is 30% nicotine and 70% water by mass percentage.

The application of the sucking particles of the present embodiment in an electrically heated cigarette indicates that at a heating temperature of 310° C. for 1-2 seconds, the formation of smoke, smoking effect, considerable smoke, thick and natural tobacco aroma and strong physiological satisfaction can be achieved.

An ordinary technical person skilled in the art should understand that the above embodiments are for the description of the present invention only and do not limit the present invention. Any changes or modifications to the above embodiments in the substantive spirit of the present invention shall fall within the scope of the claims of the present invention.

What is claimed is:

1. A sucking particle for heat-not-burn cigarettes, comprising the following components by weight fraction: 8-20 parts of microcrystalline cellulose as a pelletizing and forming carrier, 50-80 parts of tobacco powder, 0.5-2 parts of tobacco pyrolysate, 1 part of physiological taste enhancing component of tobacco to enhance physiological satisfaction and refreshing, 8-30 parts of atomizing agent to improve the amount of smoke and the taste of smoke, 0.1-2 parts of tobacco essence and 1-10 parts of propylene glycol, wherein the tobacco pyrolysate is a product of tobacco pyrolysis at 250-310° C. and wherein the tobacco that is pyrolyzed is one or more of flue-cured tobacco, air-cured tobacco or sun-cured tobacco, and the physiological taste adjusting component of the tobacco is composed of 20-40% nicotine and 60-80% water, or 5-20% caffeine and 80-95% water.

2. The sucking particle for heat-not-burn cigarettes of claim 1, wherein the tobacco pyrolysate is a product of tobacco pyrolysis at 250-310° C. by far-infrared heating.

3. The sucking particle for heat-not-burn cigarettes of claim 1, wherein the tobacco that is pyrolyzed is Zimbabwean flue-cured tobacco.

4. The sucking particle for heat-not-burn cigarettes of claim 1, wherein the physiological taste enhancing component of the tobacco is composed of 35% nicotine and 65% water.

5. The sucking particle for heat-not-burn cigarettes of claim 1, wherein the atomizing agent is polyol or an ester derivative of polyol.

6. The sucking particle for heat-not-burn cigarettes of claim 1, wherein the atomizing agent is vegetable glycerin.

* * * * *